US008826876B2

(12) United States Patent
Gruber et al.

(10) Patent No.: US 8,826,876 B2
(45) **Date of Patent: *Sep. 9, 2014**

(54) LASER SPARK PLUG FOR AN INTERNAL COMBUSTION ENGINE

(75) Inventors: Friedrich Gruber, Hippach (AT); Markus Kraus, Wiesing (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/425,571

(22) Filed: Mar. 21, 2012

(65) Prior Publication Data

US 2012/0210969 A1 Aug. 23, 2012

Related U.S. Application Data

(63) Continuation of application No. PCT/AT2010/000351, filed on Sep. 27, 2010.

(30) Foreign Application Priority Data

Oct. 7, 2009 (AT) ..... A 1579/2009

(51) Int. Cl.
*F02B 23/00* (2006.01)
*F02P 23/04* (2006.01)

(52) U.S. Cl.
CPC ..... *F02P 23/04* (2013.01)
USPC ..... 123/143 R; 123/143 B; 313/118

(58) Field of Classification Search
USPC ..... 123/143 R, 143 B, 647; 313/118, 129
See application file for complete search history.

(56) References Cited

U.S. PATENT DOCUMENTS

| | | | | |
|---|---|---|---|---|
| 7,806,094 | B2 * | 10/2010 | Gruber | 123/143 B |
| 8,146,554 | B2 * | 4/2012 | Gruber | 123/143 B |
| 8,181,617 | B2 * | 5/2012 | Kuhnert et al. | 123/143 B |
| 2006/0132930 | A1 * | 6/2006 | Kopecek et al. | 359/718 |
| 2007/0064746 | A1 * | 3/2007 | Winklhofer et al. | 372/10 |
| 2009/0107436 | A1 | 4/2009 | Schultz | |

(Continued)

FOREIGN PATENT DOCUMENTS

| | | |
|---|---|---|
| AT | 505 766 | 4/2009 |
| AT | 506 200 | 9/2009 |

(Continued)

OTHER PUBLICATIONS

International Search Report issued Apr. 27, 2011 in International (PCT) Application No. PCT/AT2010/000351.

(Continued)

*Primary Examiner* — John Kwon
(74) *Attorney, Agent, or Firm* — Wenderoth, Lind & Ponack, LLP.

(57) ABSTRACT

A laser spark plug includes a laser light-producing device and a spark plug housing at the end of which facing the combustion chamber an injection lens for injecting laser light into the combustion chamber of an internal combustion engine is arranged. The spark plug housing includes a fastening zone for fastening the laser spark plug in a cylinder head of the internal combustion engine. A projection on the end of the spark plug housing facing the combustion chamber houses the injection lens. The outer diameter (D1) of the projection is smaller in the area of the injection lens than the outer diameter (D2) of the spark plug housing in the fastening zone.

17 Claims, 6 Drawing Sheets

(56) References Cited

U.S. PATENT DOCUMENTS

| | | | | |
|---|---|---|---|---|
| 2009/0159031 | A1 | 6/2009 | Gruber | |
| 2009/0159032 | A1 * | 6/2009 | Gruber | 123/143 B |
| 2010/0275867 | A1 | 11/2010 | Weinrotter et al. | |
| 2011/0185996 | A1 * | 8/2011 | Kraus et al. | 123/143 B |

FOREIGN PATENT DOCUMENTS

| | | |
|---|---|---|
| DE | 2 207 392 | 8/1973 |
| DE | 34 00 034 | 7/1985 |
| DE | 10 2005 043 963 | 4/2006 |
| DE | 10 2007 046 312 | 4/2009 |
| DE | 10 2009 027 249 | 1/2011 |
| EP | 1 674 721 | 6/2006 |
| EP | 2 072 803 | 6/2009 |

OTHER PUBLICATIONS

Austrian Patent Office Search Report completed Apr. 15, 2010 in Austrian Patent Application No. A 1579/2009.

* cited by examiner

LASER SPARK PLUG FOR AN INTERNAL COMBUSTION ENGINE

This application is a Continuation of International application No. PCT/AT2010/000351, filed Sep. 27, 2010, the entire disclosure of which is incorporated herein by reference.

BACKGROUND OF THE INVENTION

The invention concerns a laser spark plug comprising a laser light producing device and a spark plug housing, at whose end towards the combustion chamber there is arranged a coupling-in optical means for coupling laser light into the combustion chamber of an internal combustion engine. The spark plug housing has a fastening region for fastening the laser spark plug in a cylinder head of the internal combustion engine.

The invention further concerns an arrangement including a laser spark plug of the aforementioned kind and a cylinder head having a fixing region for the fastening region of the laser spark plug. Finally, the invention concerns an internal combustion engine, in particular a gas engine, comprising such an arrangement.

Laser ignition is an ignition system which is in an intensive development phase and which has fundamental advantages over conventional spark ignition. One of those advantages is the absence of erosive wear and hot corrosion at the spark plug electrodes, which in conventional electric spark ignition, specifically in relation to the high power density levels of modern gas engines, lead to reduced spark plug service lives and thus considerable operating costs. The increase in the power density of the engine, which is one of the main focuses in engine development, does not represent any difficulty for laser ignition.

Laser ignition to which reference is made in this proposed invention comprises a laser spark plug in which the laser light pulse which lasts only a few nanoseconds is produced with sufficiently high energy. The laser light beams issuing, from for example, a laser crystal are concentrated and focused by way of a suitable optical means and coupled into the combustion chamber by way of a light-transmissive window, the so-called coupling-in optical means or the combustion chamber window, at the end of the laser spark plug, at the combustion chamber side. The plasma spark or ignition spark is produced at the focal point of the laser light beams. The laser ignition system further has an optical pumping device where a quasi-continuous laser light of suitable wavelength is produced. The Laser light is passed by way of a glass fiber cable to the laser crystal in the laser spark plug, and the laser crystal is activated with the laser light until the laser pulse is triggered. To ensure optimum and reliable operation of the laser crystal with the integrated optical interfaces and switches, it is crucial that the temperature of the laser spark plug at the location of installation of the laser crystal is kept as low as possible. In large high-power gas engines, the components delimiting the combustion chamber are subjected to very high thermal loading. Added to that there are often long spark plug shafts in which the spark plugs are fitted and where the wall temperatures are already about 90° C. No higher temperature than a maximum of 130° C. should occur at the laser crystal in operation.

That can be achieved only with difficulty with the geometrical configurations known at the present time of the laser spark plugs, under unfavorable boundary conditions.

SUMMARY OF THE INVENTION

Therefore, the object of the present invention is to provide devices of the kind set forth in the opening part of this specification, in which those disadvantages are reduced, that is to say in which there are no temperature problems in the region of the laser light producing device, generally a laser crystal.

That object is attained in that, arranged at the end of the spark plug housing, that is towards the combustion chamber, is a projection in which the coupling-in optical means is disposed. The outside diameter of the projection is smaller in the region of the coupling-in optical means than the outside diameter of the spark plug housing in the fastening region.

The invention is based on the realization that heat radiation on to the laser spark plug from the combustion chamber is to be kept as low as possible and the heat is to be dissipated from the spark plug housing to the cylinder head wall by way of a heat-dissipating contact surface area which is as large as possible. By the combustion chamber window being held in a region, namely the projection, which has a smaller outside diameter than the fastening region, on the one hand less heat is absorbed from the spark plug as the projection is of a smaller area which is exposed to the combustion chamber, in the region of the coupling-in optical means. On the other hand, more heat can be dissipated by way of the thicker region of the fastening. The proposed solution is further based on the new realization that only a relatively small light passage element (coupling-in optical means) is required at the combustion chamber window. The light cone can be of a diameter of less than 5 mm, preferably however about 3 mm, at the surface of the coupling-in optical means, that is at the combustion chamber side. Thus, together with the fastening of the coupling-in optical means in the spark plug housing, an overall outside diameter at the end of the laser spark plug, at the combustion chamber side, of not more than about 8 mm is required. Furthermore, it has been found in the tests for optimizing laser ignition that the aim should be to have a numerical aperture which is as high as possible for the optical focusing means, that is to say an aperture angle which is as large as possible for the light cone with the focus as the tip thereof.

It is preferably provided that the fastening region includes a male screwthread (that is to say, the spark plug can be fastened in the cylinder head with a screw thread.) The projection is arranged after the male screwthread in the direction towards the combustion chamber.

The projection can be, for example, (at least region-wise) in the shape of a right circular cylinder, the outside diameter of which is then smaller than the outside diameter in the fastening region, preferably of the male screwthread.

To make the laser spark plug of a configuration which is as sealingly seated as possible, the projection (at least region-wise) can be in the shape of a truncated cone. Desirably, the cylinder head is shaped so that the truncated cone bears in sealingly seated relationship in the receiving region of the cylinder head for the spark plug.

It can further be provided that the ratio of the outside diameter in the fastening region D2 to the smallest outside diameter D1 in the region of the projection is between 1.5 and 2.5.

It can further be provided that the ratio of the length of the projection to the smallest outside diameter in the region of the projection is between 0.8 and 1.2.

It can further be provided that the smallest outside diameter in the region of the projection is between 7 mm and 10 mm.

In accordance with the invention, an arrangement includes a laser spark plug of the aforementioned kind and a cylinder head having a fixing region for the fastening region of the laser spark plug. It is further preferably provided that the fixing region has a female screwthread corresponding to the male screwthread of the laser spark plug. In that respect, it is preferably provided that the cylinder head has a receiving region for the laser spark plug, which is of such a configuration that the end of the projection that is towards the combustion chamber terminates substantially flush with the wall of the combustion chamber.

For example, the projection can be arranged at least region-wise in sealingly seated relationship in the cylinder head. Arranged in front of the fixing region along the longitudinal axis of the laser spark plug in the direction of the combustion chamber can be sealing element which is of higher thermal conductivity than the spark plug housing, which is heat-conductingly arranged between the cylinder head and the spark plug housing.

Finally, arranged after the fixing region along the longitudinal axis in the direction of the combustion chamber can be sealing element which is of higher thermal conductivity than the spark plug housing and which is heat-conductingly arranged between the cylinder head and the spark plug housing.

For even better heat dissipation, a cooling passage can at least region-wise surround the fixing region. It can also be provided that this cooling passage also at least partially surrounds the projection.

In summary, it can be said that the proposed solution according to the invention provides that the laser spark plug has a projection, for example a cylindrical and/or frustoconical projection, forming the end part of the laser spark plug, towards the combustion chamber. Adjoining the projection rearwardly is an enlargement portion which can serve as a sealing seat surface and for heat dissipation. That sealing seat can be either a flat sealing seat or a conical sealing seat. That sealing seat is in turn adjoined by the fastening region, preferably a male screwthread, serving for fastening the laser spark plug to the internal combustion engine or screwing it thereinto. The fastening region or the male screwthread of the laser spark plug terminates upwardly for example with a screw-in portion, for example a hexagon. For additional heat conduction, a very soft-elastic support ring of material which is a very good heat conductor can be provided at that location.

All the stated features essentially serve to provide that the heat input surface from the combustion chamber is relatively small because of the small end diameter, at the combustion chamber side, of the laser spark plug, and a large part of the heat transmitted to the laser spark plug is dissipated into the preferably water-cooled cylinder head wall. Optionally provided heat-dissipating, preferably areal sealing elements and heat-conducting sealing elements which are arranged at a very small spacing relative to the end towards the combustion chamber of the laser spark plug for example in the form of a support ring between the screw-in portion (for example hexagonal shoulder) and fixing region or cylinder head wall, also involving a large surface area, promote the dissipation of heat into the cylinder wall.

It is thus possible to ensure that the heat is dissipated over a very wide and long laser spark plug region into the cylinder head wall. With decreasing temperature of the cylinder wall at an increasing distance relative to the combustion chamber surface, the temperature of the spark plug housing decreases in the same way as the cylinder wall, and has only a slight excess in relation to the engine cooling water temperature at the location of the contact surface.

In principle, the laser spark plug could also be designed so that beneath the fastening region it only involves heat dissipation through a sealing element in the form, for example, of a soft-elastic contact ring and above the threaded portion a sealing element as a sealing seat (with a corresponding seal between the contact surface and the spark plug housing shoulder). The advantage of the solution with a sealing seat between the fastening portion and the coupling-in optical means, however, lies in the better sealing action due to the smaller sealing seat surface, as for example in the case of the flat seal, or due to the larger heat dissipation surface with a correspondingly advantageous pressure in relation to surface area when using a conical sealing seat.

The invention further concerns an internal combustion engine, in particular a gas engine, having an arrangement of the aforementioned kind. That gas engine is preferably an engine which is operated on the basis of the Otto cycle, with at least one reciprocating piston/cylinder arrangement. Generally however this involves multi-cylinder internal combustion engines.

BRIEF DESCRIPTION OF THE DRAWINGS

Further advantages and details of the invention are described with reference to the accompanying Figures and the specific description relating thereto. In the Figures.

DETAILED DESCRIPTION OF THE INVENTION

Figure 1:
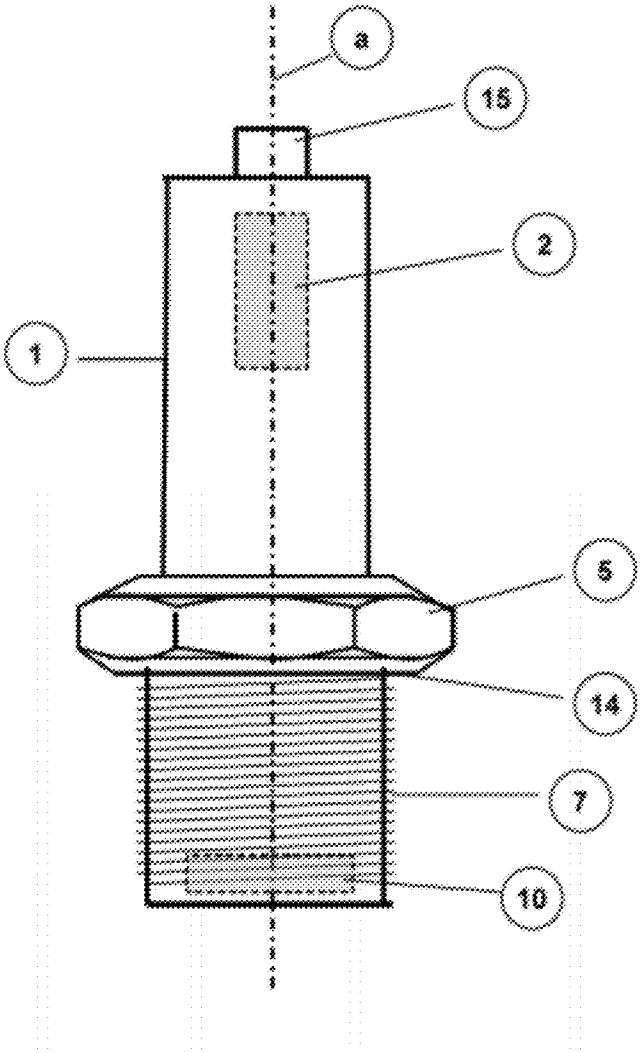
FIG. 1 shows a laser spark plug according to the state of the art.

FIG. 1 diagrammatically shows a laser spark plug in accordance with the state of the art. It includes a spark plug housing 1 extending along the longitudinal axis of the laser spark plug a. The coupling-in optical member 10—also referred to as the combustion chamber window—is arranged at an end, (more specifically the end towards the combustion chamber) of the laser spark plug. The coupling-in optical member 10 is responsible for coupling the laser light produced by a laser light producing device 2 into the combustion chamber of the internal combustion engine. The laser light producing device 2 in this case is in the form of a monolithic solid-state laser (laser crystal) and is fed by a pump light source (not shown). Disposed at the connection (upper) end of the laser spark plug is a connection portion 15 for introducing the pump light.

Disposed at the end of the laser spark plug, towards the combustion chamber, is a fastening region 7 in the form of a male screwthread 7 for screwing into the cylinder head of an internal combustion engine. The coupling-in optical member 10 is surrounded by the fastening region 7, that is to say the male screwthread. For more easily fastening the laser spark plug in the cylinder head, there is further provided a screw-in portion 5 in the form of a hexagon which permits fastening or release of the laser spark plug with a tool for screwing, such as for example a fixed-jaw wrench. A flat sealing seat 14 which adjoins the fastening region 7 along the longitudinal axis a in the direction of the connection end is responsible in the installed condition for the dissipation of heat from the laser spark plug to the cylinder head.

Figure 2:
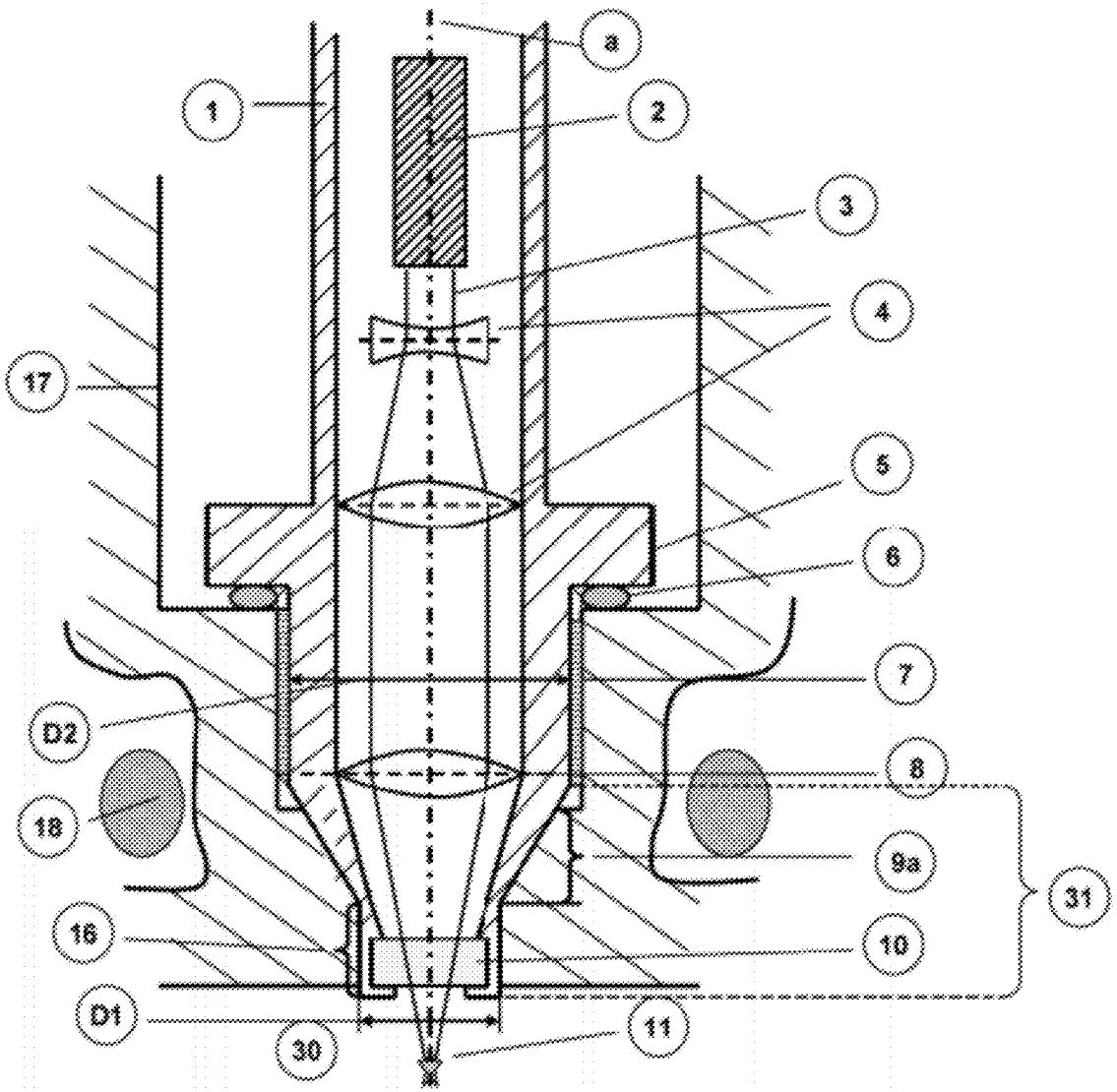
FIG. 2 shows an example according to the invention of a laser spark plug.

FIG. 2 shows the laser spark plug according to the invention with cylinder head 17 (in each case partly broken away). The laser spark plug includes a spark plug housing 1 which extends along the longitudinal axis a and in which is arranged a laser light producing device 2. The laser spark plug along the longitudinal axis a has a combustion chamber end which in the installed condition extends into the combustion chamber 30 of an internal combustion engine, and a connection end (upward in the drawing, not shown in detail; attention is directed to FIG. 1 which has the same structure at the connection end), serving for the connection of a pump light source. Arranged at the combustion chamber end of the laser spark plug is the coupling-in optical member 10 which is held in the spark plug housing 1 in positively locking relationship.

In addition, there is a laser light producing device 2 in the form of a monolithic solid-state laser (laser crystal). The laser light producing device 2 produces laser light, the beam path 3 of which is illustrated. The laser light is expanded in optical elements 4 so that this results in a larger beam diameter. A focusing lens 8 focuses the laser light towards the coupling-in optical member 10 which permits the light to issue from the laser spark plug, and finally on to the focal point 11 in the combustion chamber 30 where the ignition spark is produced in the operating condition. The spark plug housing 1 has a fastening region 7 in the form of a male screwthread making a releasable fastening to the cylinder head 17 by way of the fixing region 7*a*. The fixing region 7*a* is in the form of a female screwthread 7*a* corresponding to the male screwthread 7. A projection 31 in which the coupling-in optical member 10 is arranged extends along the longitudinal axis a in the direction of the combustion chamber 30 and more specifically at the combustion chamber end of the laser spark plug. The coupling-in optical member 10 is arranged in the projection 31 which adjoins the threaded region 7 towards the combustion chamber. In this case, the projection 31 has a frustoconical first region in which the spark plug housing bears against the cylinder head 17 in sealingly seated relationship in a throat 9*a*. Adjoining the frustoconical region there is also a circular-cylindrical region 16 in which the coupling-in optical member 10 is held in positively locking relationship.

In addition, a sealing element 6 is arranged in the direction of the connection end of the laser spark plug immediately after the threaded region 7 but still before the screw-in portion 5 in the form of a hexagon. The sealing element 6 is in the form of a soft-elastic, heat-dissipating contact ring and bears against a flat sealing seat. It can be clearly seen that the outside diameter D2 in the threaded region 7 is larger than the maximum outside diameter D1 in the region of the projection 31 at the coupling-in optical member 10.

A cooling passage 18 surrounds both the threaded (male) fastening region 7 and also the projection 31 and dissipates heat by way of a cooling fluid (such as cooling water). The receiving region in the cylinder head 17 for the laser spark plug is of such a configuration that the laser spark plug can be introduced in such a way that the combustion chamber end of the projection 31 terminates substantially flush with the wall of the combustion chamber 30.

Figure 3:
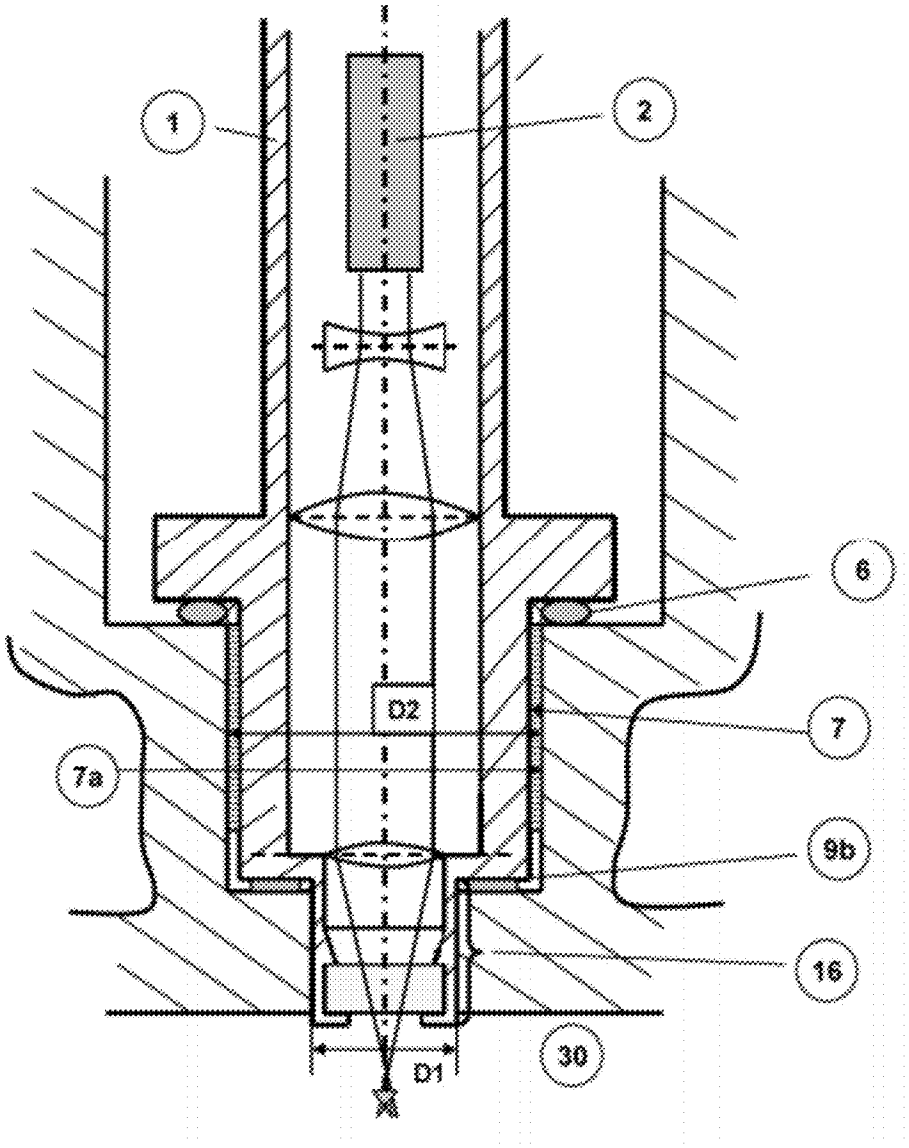
FIG. 3 shows a further example according to the invention of a laser spark plug.

FIG. 3 shows an embodiment differing from the embodiment of FIG. 2 in the form of the projection 31 and of the sealing elements 9*b*. The projection 31 is more specifically of a circular-cylindrical shape over the entire length 16, wherein the outside diameter D1 is again markedly smaller than the outside diameter D2 in the threaded region 7. Instead of the sealingly seated frustoconical region for heat dissipation, a sealing element 9*b* is also arranged after the fastening region 7 beside the sealing element 6 along the longitudinal axis a of the laser spark plug in the direction of the combustion chamber 30.

Figure 4:
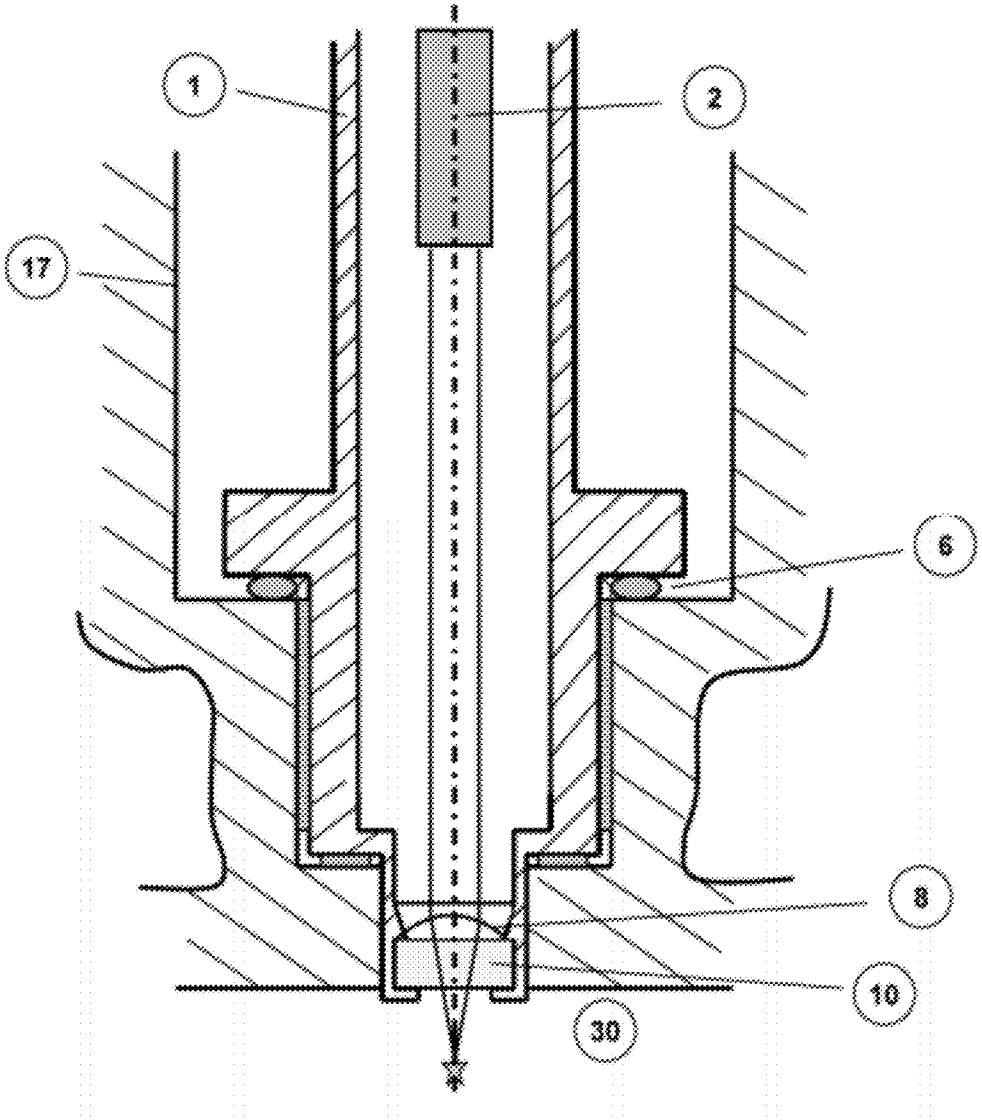
FIG. 4 shows a simplified example of a laser spark plug as shown in FIG. 3.

FIG. 4 shows an embodiment differing from the FIG. 3 embodiment in that there are no optical elements 4 for expanding the laser beam diameter.

Figure 5:
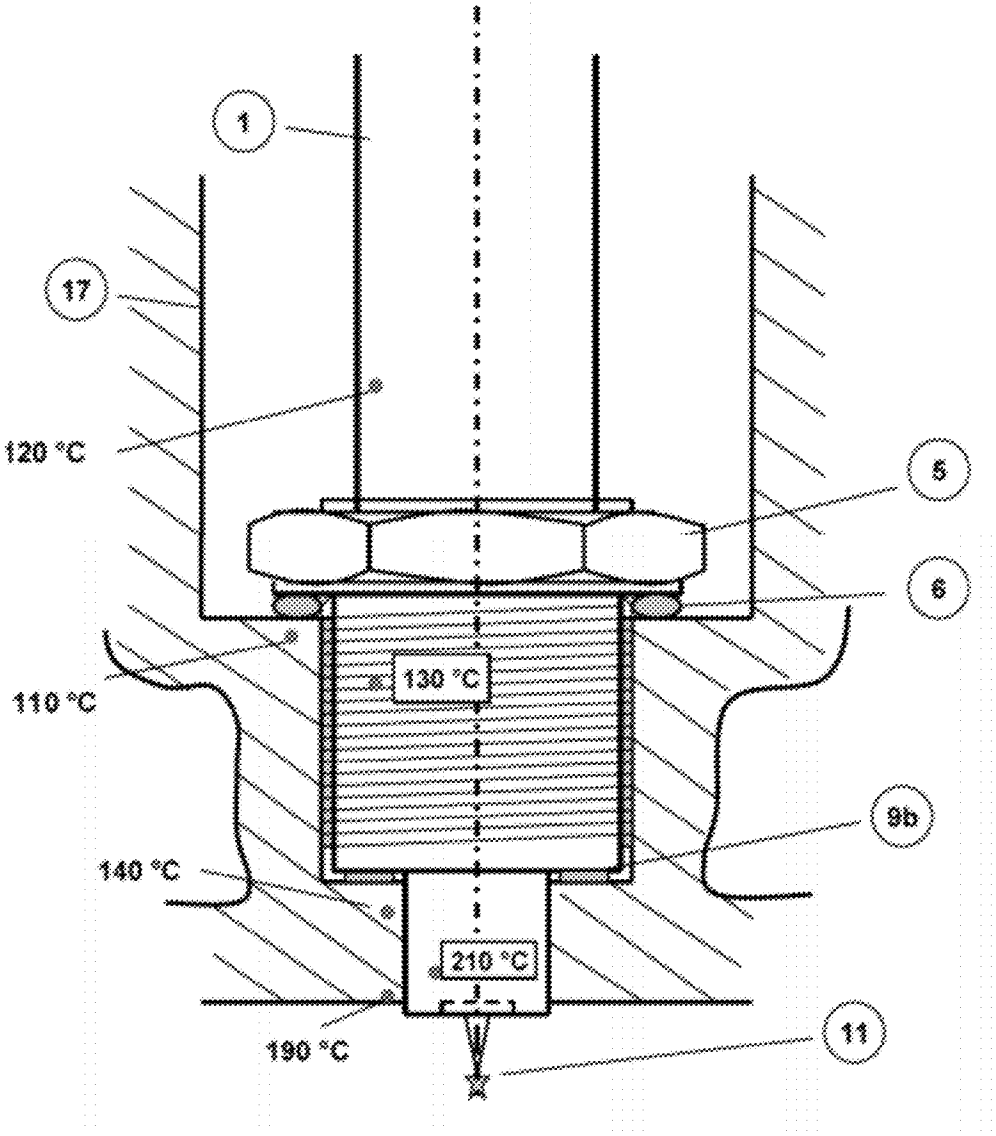
FIG. 5 shows the temperature variation in the operating condition with the laser spark plug of FIG. 3.

FIG. 5 shows ascertained temperature values along the laser spark plug of FIG. 3 in ° C. In comparison with the high temperatures of over 200° C. occurring at the coupling-in optical means 10 at the combustion chamber 30 the shape according to the invention of the laser spark plug and the provision of sealing elements 6, 9*b* which are of higher thermal conductivity than the spark plug housing 1 can provide that heat is quickly and efficiently dissipated in the direction of the laser light producing device 2 (not shown here). That protects the laser light producing device 2 from premature wear.

Figure 6:
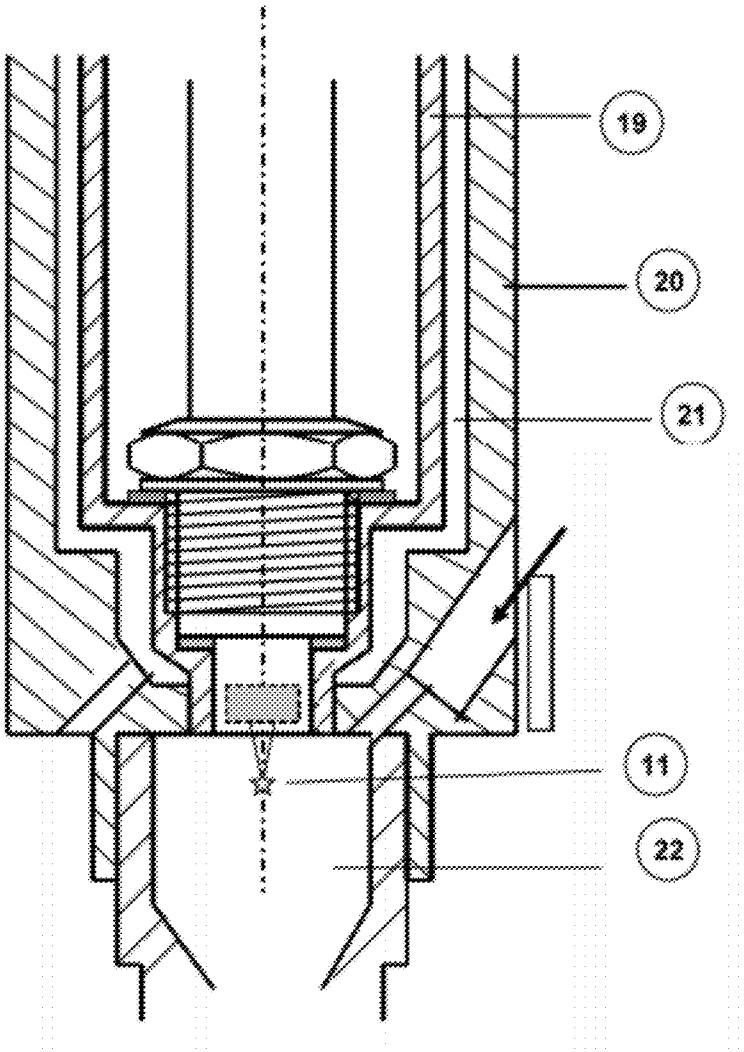
FIG. 6 shows a last example of a laser spark plug.

FIG. 6 additionally shows a structure having a separate spark plug receiving member comprising an inner housing 19 and an outer housing 20. A fluid can be introduced between the inner housing 19 and the outer housing 20 and cools the laser spark plug with a cooling device. The laser spark plug, however, could also be heated for example when being brought into operation by a heating device to more rapidly reach operating temperature. This example also has a prechamber 22 in which a fuel/air mixture is ignited, that ignited mixture then passing into the actual combustion chamber 30 and there causing combustion of the fuel/air mixture.

The invention claimed is:

1. An arrangement comprising:

a cylinder head having a fixing region, a cooling passage within said cylinder head and configured to surround said fixing region, and a combustion chamber;

a laser spark plug including:

a laser light producing device;

a spark plug housing having a first end at said combustion chamber, and having a fastening region for fastening said laser spark plug to said fixing region of said cylinder head; and a coupling-in optical member at said first end of said spark plug housing for coupling laser light into said combustion chamber;

wherein said spark plug housing has a projection at said first end, said coupling-in optical member being arranged within said projection, an outside diameter of said projection being smaller at a location of said coupling-in optical member than an outside diameter of said fastening region of said spark plug housing.

2. The arrangement of claim 1, wherein said fastening region includes a male screwthread, and said projection is located at a combustion-chamber side of said male screwthread.

3. The arrangement of claim 1, wherein at least a portion of said projection has a right circular cylindrical shape.

4. The arrangement of claim 1, wherein at least a portion of said projection has a truncated conical shape.

5. The arrangement of claim 1, wherein a ratio of said outside diameter in said fastening region to a smallest outside diameter of said projection is between 1.5 and 2.5.

6. The arrangement of claim 1, wherein a ratio of a length of said projection to a smallest outside diameter of said projection is between 0.8 and 1.2.

7. The arrangement of claim 1, wherein a smallest outside diameter of said projection is between 7 mm and 10 mm.

8. The arrangement of claim 1, wherein said fixing region includes a female screwthread corresponding to a male screwthread of said fastening region of said spark plug housing.

9. The arrangement of claim 1, wherein said cylinder head has a receiving region for receiving said laser spark plug, said receiving region being configured such that an end of said projection closest to said combustion chamber terminates substantially flush with a wall of said combustion chamber.

10. The arrangement of claim 1, wherein said projection is arranged in a sealingly-seated relationship in said cylinder head.

11. The arrangement of claim 1, further comprising a sealing element arranged on said spark plug housing farther from said combustion chamber than said fastening region of said spark plug housing with respect to a longitudinal axis of said laser spark plug, said sealing element having a higher thermal conductivity than said spark plug housing and being arranged to thermally connect said cylinder head and said spark plug housing.

12. The arrangement of claim 1, further comprising a sealing element arranged on said spark plug housing closer to said combustion chamber than said fastening region of said spark plug housing with respect to a longitudinal axis of said laser spark plug, said sealing element having a higher thermal conductivity than said spark plug housing and being arranged to thermally connect said cylinder head and said spark plug housing.

13. The arrangement of claim 1, wherein said cooling passage also at least partially surrounds said projection.

14. The arrangement of claim 1, wherein said cylinder head further has a prechamber into which said coupling-in optical member opens.

15. The arrangement of claim 1, further comprising a spark plug receiving member arranged between said cylinder head and said laser spark plug, said spark plug receiving member having at least one of a cooling device and heating device for adjusting a temperature of said laser spark plug.

16. The arrangement of claim 15, wherein said spark plug receiving member has an inner housing and an outer housing, said spark plug receiving member being configured to allow a fluid to be introduced between said inner housing and said outer housing.

17. The arrangement of claim 1, further comprising an internal combustion gas engine including said cylinder head.

* * * * *